United States Patent [19]

Beznosjuk et al.

[11] 4,326,823

[45] Apr. 27, 1982

[54] ROTATING CUTTING TOOL

[76] Inventors: Evgeny I. Beznosjuk, proezd Shokolskogo, 27, korpus 2, kv. 182, Moscow; Leonid B. Doktorov, Leningradskoe shosse, 18, kv. 27, Khimki Moskovskoi oblasti; Vyacheslav E. Musyakin, Sireneyy-Bulvar 36, kv. 51; Sergei V. Kolomeets, Volgogradsky Prospect 164, korpus 2, kv. 95, both of Moscow, all of U.S.S.R.

[21] Appl. No.: 154,212

[22] Filed: May 29, 1980

[51] Int. Cl.[3] ..... B26D 1/12

[52] U.S. Cl. ..... 407/51; 29/78; 29/81 J

[58] Field of Search ..... 407/51, 52, 55; 29/78, 29/79, 81 J, 81 H, 81 L, 81 R

[56] References Cited

U.S. PATENT DOCUMENTS

| | | | |
|---|---|---|---|
| 3,557,418 | 1/1971 | Salukvadze | 407/51 |
| 3,928,900 | 12/1975 | Salukvadze et al. | 407/51 |
| 4,070,130 | 1/1978 | Salukvadze et al. | 407/33 |
| 4,172,682 | 10/1979 | Salukvadze et al. | 407/51 |

*Primary Examiner*—Leonidas Vlachos

*Attorney, Agent, or Firm*—Robert E. Burns; Emmanuel J. Lobato; Bruce L. Adams

[57] ABSTRACT

The invention relates to cutting tools for metal working. The claimed cutting tool (needle-cutter) comprises cutting elements assembled at least into two sets and presenting essentially pieces of wire. The cutting elements are fastened to one another at one end, thereby forming the internal non-working surface while their other free ends form the working surface. According to the invention the working surface is essentially a disc having the side edges arranged at an angle substantially equal to 90°. The diameter of each cutting element and the mean length thereof in a set are represented by the following ratios:

$$d_1^4/l_{S1}^2 = d_2^4/l_{S2}^2 = \ldots d_n^4/l_{Sn}^2,$$

where:

$d_1, d_2 \ldots d_n$ are the diameters of the cutting elements in sets;

$l_{S1}, l_{S2} \ldots l_{Sn}$ are the mean lengths of the cutting elements in sets;

1, 2 . . . n are the numbers of sets.

4 Claims, 3 Drawing Figures

ROTATING CUTTING TOOL

The invention relates to cutting tools for metal working and more particularly to rotating cutting tools (needle-cutters).

The invention may be most advantageously used in metallurgy, at metal construction manufacturing plants and other enterprises dealing with the rolled angles which before use should be cleaned of scale, rust and contaminants, and then painted for protection against corrosion.

Known to the prior art is a rotating cutting tool (needle-cutter) comprising at least two sets of cutting elements presented by pieces of wire fastened to one another at one end, thereby forming the internal non-working surface while their other free ends constitute the working surface in the form of a body of rotation.

Such a tool is used for cleaning round steel bars and faces of square bars, and also the external surface of rolled angles.

Such brush type rotary cutters are not intended for cleaning the internal surface of rolled angles.

Also known to the prior art is a rotating cutting tool (needle-cutter) having the working surface in the form of a cylindrical body of rotation. Working the internal surface of the rolled angles with such a tool will require two brush type rotary cutters for cleaning the angle wings individually and one more specially profiled needle-cutter for cleaning the angle along the fillet radius. However, the equipment, especially the machine on which these tools are to be installed will become more complicated, as in this case it is necessary to have three individual units with drives for said tools. This will cause an increase in the length of such a machine and will make the operation thereof more complicated. Moreover, each of these tools cleans the rolled angle in its own manner which results in low quality of cleaning.

The attempts made to clean the internal surface of a rolled angle with one above-mentioned tool by preliminarily working (grinding) the working surface thereof were also a failure. This is explained by the fact that in a known tool (needle-cutter) the cutting elements have a markedly different length which results in a different flexibility and cutting ability. The endurance of such a tool is low. Moreover, for cleaning the rolled angle with a wing exceeding 50 mm this tool is practically unsuitable, as with an optimum length of the middle cutting elements of the tool 70 mm the extreme (side) cutting elements thereof will have the length close to zero.

It is the principal object of the present invention to provide a rotating cutting tool (needle-cutter) which will possess a uniform cutting ability along the entire perimeter of the working surface.

This and other objects are accomplished by that in a rotating cutting tool comprising at least two sets of cutting elements presented by pieces of wire fastened to one another at one end, thereby forming the internal non-working surface while their other free ends constitute the working surface in the form of a body of rotation, according to the invention the working surface presented by the free ends of the cutting elements is essentially a disc with the side edges thereof arranged at an angle substantially equal to 90°, the diameter of each cutting element and the mean length thereof in a set being represented by the following mutually equal ratios:

$$d_1^4/l_{S1}^2 = d_2^4/l_{S2}^2 = \ldots d_n^4/l_{Sn}^2,$$

where:

$d_1, d_2 \ldots d_n$ are the diameters of the cutting elements in sets;

$l_{S1}, l_{S2} \ldots l_{Sn}$ are the mean lengths of the cutting elements in sets;

1, 2 . . . n are the numbers of sets.

The adopted design configuration of the brush type rotary cutter is accounted for by the necessity for this tool to exactly fit into the internal surface of a rolled angle whose wings are arranged at 90°; the top surface of the needle cutter is rounded off round a radius equal to the fillet radius of a rolled angle.

The need for holding the above-mentioned ratios constant is substantiated by the following considerations.

In order that all the cutting elements (wire pieces) of the tool be capable of taking up the same load and possessing the same stiffness, and consequently the same cutting ability for each of the cutting elements, this maximum load (critical force) must be constant, i.e.

$$P_c = \pi^2 E J_{min}/4l^2 = \text{const}, \quad (1)$$

where:

$P_c$ is the critical force;

E is the modulus of elasticity of a cutting element material;

$I_{min}$ is the moment of inertia;

l is the length of a cutting element;

$\pi = 3.14$.

The moment of inertia for round cutting elements $$J = \pi d^4/64 \quad (2)$$

Having substituted the equation (2) into the equation (1), we get $$P_c = (\pi^2 E \cdot \pi \cdot d^4)/(4 \cdot l^2 \cdot 64) = (\pi^3 \cdot E)/256 = d^4/l^2 = \text{const} \quad (3)$$

As the expression $\pi^3 E/256$ for cutting elements made from one material is constant, then in order to enable the total to take up one and the same critical load, the ratio $d^4/l^2$ must be constant for all the sets of cutting elements.

A tool effected according to the given proposal in the form of a disc with a 90° angle between the side edges thereof and with the ratio $d^4/l^2$ being constant, will possess the same cutting ability along the entire profile and will ensure a good quality of cleaning.

This aim may specifically be attained with the aid of tools of different designs. In one of the tool designs the cutting elements in each set may have the same length and the same diameter. It will be understood that the ratio $d^4/l^2$ for each set is constant. In developing such a tool, the width of each set of cutting elements on the working surface of the tool should be pre-assigned, and depending on the length of the cutting elements the width of the sets on the internal non-working surface will be obtained.

In the given case, it is possible to assemble the needle-cutters with any required width of the working surface, provided that each set is manufactured with a sufficient accuracy to ensure the precise jointing of the sets.

In another embodiment of the tool the cutting elements in the sets may have different lengths and different diameters, however the ratio $$d_1^4/l_{S1}^2=d_2^4/l_{S2}^2=d_3^4/l_{S3}^2$$

must remain constant.

In this case, it is preferable to use the needle-cutters for cleaning the rolled angles with a wing of up to 50 mm.

In still another embodiment of the tool the cutting elements in each set may have an equal diameter and a variable length uniformly diminishing away from the axis perpendicular to the axis of rotation, towards the periphery, the mean length of the cutting elements remaining constant.

In this case the lengths of the cutting elements are varying in the neighbourhood of the their mean value which must be constant in all the sets.

The invention will be further understood and its various advantages better appreciated from the following description of several exemplary embodiments thereof taken in conjunction with the accompanying drawings, wherein.

Figure 1:
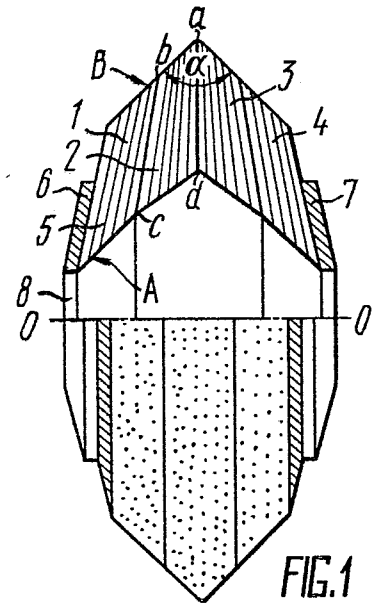
FIG. 1 is a general view taken in longitudinal section before the axis of symmetry, showing a rotating cutting tool (needle-cutter) comprising four sets of cutting elements of the equal length and diameter in a set, according to the invention.

A rotating cutting tool (needle-cutter), as illustrated in FIG. 1, is made up of a plurality of sets 1, 2, 3, 4 of cutting elements 5, closely adjoining one another. The cutting elements 5 are made in the form of wire pieces (rods) fastened to one another a one end, for example, by welding and forming an internal non-working surface A of the needle-cutter.

This surface A has the form of a body of rotation with a broken generatrix.

The sets 1, 2, 3, 4 are in turn rigidly fastened with one another.

The free ends of the cutting elements 5 make up a working surface B of the needle-cutter, which has the form of a body of rotation with the axis of rotation 0—0.

According to the invention the working surface B of the tool is essentially a disc with the side edges thereof arranged at an angle $\alpha$ substantially equal to 90°. The tool top proper is worked (ground) round a radius equal to the fillet radius of a rolled angle to be cleaned.

In all the sets 1,2,3,4 the cutting elements 5 are equal both in length and diameter. From this it follows that their flexibility (elasticity) depending (at equal density of the cutting elements 5 in the sets) on the ratio $d^4/l_S^2$, where:

d is the diameter of the cutting elements;

$l_S$ is the mean length of the cutting elements, being constant.

Attached to the extreme sets 1 and 4 of the cutting elements 5 on the side of their free ends are flanges 6 and 7 respectively, provided with holes 8 through which a drive shaft (not shown in the Figure) is passed.

Constructionally, such needle-cutters may be made up of two sets for rolled angles with a wing less than 50 mm. For rolled angles with a wing of 50 to 100 mm and over 100 mm, it is advantageous to use the needle-cutters comprising four and six sets of the cutting elements, respectively.

Example of Calculation.

Let's assume that it is required to manufacture a tool for cleaning a rolled angle with the wing width $\delta=60$ mm and the maximum diameter of the tool $D_{max}=400$ mm. The length of cutting elements $l=60$ mm. Divide the tool into four circular sets each having the width of the working surface $\delta/2=30$ mm. The tool is symmetrical; the set 1 is identical with the set 4 and the set 2, with the set 3. The problem reduces to calculating the geometric parameters of the sets 1 and 2.

Let's start the calculation with the set 2 (FIG. 1, section abcd):

(1) for point "a" $D_{max}=400$ mm (2) for point "d" $D_{max}-2l=400-2.60=280$ mm (3) for point "b" $D_{max}-2\delta/2 \cos 45°=400-2\cdot 3\cdot 0\cdot 0.7=358$ mm.

(4) For finding the point "c", determine a segment cd.

To this end, determine the mean diameters of the set 2 on the working surface B and the non-working surface A of the tool $$D_B=(400+358)/2=379 \text{ mm};$$

$D_B$ is the mean diameter of the set 2 on the working surface B.

$$D_A=D_B-2l=379-2.60=259 \text{ mm};$$

$D_A$ is the mean diameter of the set 2 on the non-working surface A.

The areas of surfaces of the set 2 on the working surface B and the non-working surface A are inversely proportional to their space factors $\varphi_B$ and $\varphi_A$.

The space factor of the working surface B is assumed to be $\phi_B=0.75$ and that of the non-working surface A is assumed to be $\varphi_A=0.9$.

$$S_B/S_A=\varphi_A/\varphi_B \text{ or } (\pi D_B\cdot ab)/\pi D_A\cdot cd)=\varphi A/\varphi_B$$

Whence the length of the segment $$cd=(D_B\cdot ab\cdot\varphi_B)/D_A\cdot\varphi_A)=(379\cdot 30\cdot 0.75)/(259\cdot 0.9)=36.5 \text{ mm}.$$

Knowing the lengths of the segments bc=60 mm and cd=36.5 mm, let's graphically determine the coordinate of their intersection. The point "c" is found on a diameter of 243 mm.

In this manner all the coordinates of the set 2 and of the identical set 3 are determined.

The coordinates of the set 1 are determined using the same principle.

Figure 2:
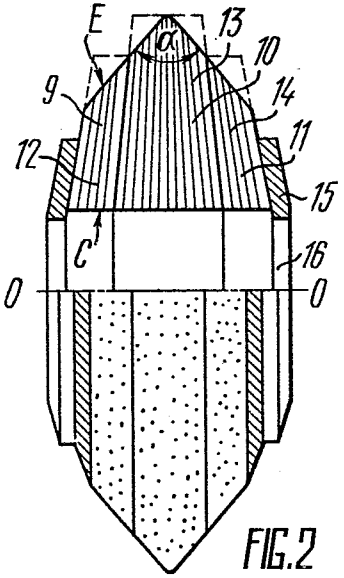
FIG. 2 is a general view taken in longitudinal section before the axis of symmetry, showing a rotating cutting tool (needle-cutter) comprising three sets of cutting elements of the different length and diameter in a set, according to the invention.

A rotating cutting tool, as illustrated in FIG. 2, is made up of mutually fastened sets 9, 10, 11 of cutting elements 12, 13, 14 which form an internal non-working cylindrical surface C and an external working surface E. The tool is preliminarily assembled according to the contour (dash line) denoted in the drawing. In this tool (blank) the diameters and lengths of the cutting elements in different sets are different but in one individual set they are constant. Extreme sets 9 and 11 are fastened to flanges 15 provided with holes 16 for installing the tool on a drive shaft (not shown in the Figure).

The tool blank is ground on the external surface E to make a profile in the form of a disc with the apex angle $\alpha$ equal to 90°. The lengths of the cutting elements 12, 13, 14 in each of the sets 9, 10, 11 diminish away from the axis perpendicular to the axis of rotation 0—0, towards the periphery. The mean lengths $l_{S12}$, $l_{S13}$, $l_{S14}$ of the cutting elements 12, 13, 14 are also different and are associated with their diameters $d_{12}$, $d_{13}$, $d_{14}$ by the ratio:

$$d_{12}^4/l_{S12}^2=d_{13}^4/l_{S13}^2=d_{14}^4/l_{S14}^2=\text{const.}$$

Although the tool of the given design is simple in manufacture, it is suitable only for cleaning the rolled angles with a wing of up to 50 mm. In such a tool the cutting ability of each set is somewhat varying in the neighbourhood of the mean value which remains constant. Therefore, to exclude an adverse effect of the varying cutting ability of the tool on the quality of cleaning, it is preferred to make up a tool of the sets having a small width, in which the length of the cutting elements will vary by not more than ±10 percent relative to the mean value.

Example of Calculation.

Let's assume that it is required to calculate a tool for cleaning a rolled angle with the wing width $\delta=40$ mm. Select the width of the sets such that the extreme sets will clean the angle wings on the sections having the width $\delta/2=20$ mm each, and the central set will clean the angle wings on both sides from the apex, each having the width $l/2=20$ mm. Let's have the maximum length $l_{13}^{max}$ of the cutting elements 13 in the central set 10 equal to 68 mm and their diameter $d_{13}=0.5$ mm.

Determine geometrically the mean lengths $l_{S12}$ and $l_{S14}$ of the cutting elements 12 and 14:

$$l_{S12}=l_{S14}=50\text{ mm},\ l_{S13}=62\text{ mm}.$$

Determine $d_{12}=d_{14}$ $$d_{12}^4/50^2=0.5^4/62^2 \text{ or } d_{12}^4=0.5^4\cdot(50/62)^2$$

Then $d_{12}=0.5\cdot\sqrt{0.8}=0.45$ mm.

The blank of such a tool is made up of the cutting elements 12 and 14 having the maximum value for each set:

$$l_{12}^{max}=l_{14}^{max}=56\text{ mm},\ l_{13}^{max}=68\text{ mm}.$$

Figure 3:
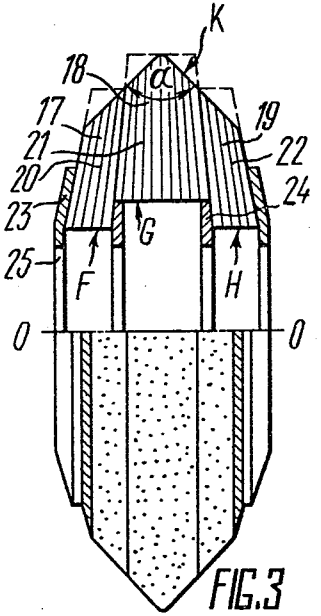
FIG. 3 is a general view taken in longitudinal section before the axis of symmetry, showing a rotating cutting tool (needle-cutter) comprising three sets of cutting elements of the different length and equal diameter in a set, according to the invention.

A rotating cutting tool, illustrated in FIG. 3, is made up of three sets 17, 18, 19 of cutting elements 20, 21, 22 respectively, closely adjoining one another. The sets 17, 18, 19 are installed stepwise, thereby forming a non-working surface comprising cylindrical surfaces F, G, H of three cylinders of which the central cylinder formed by the surface G has a greater diameter than the side cylinders. Let letter K denote the working surface. The blank of such a tool is assembled of sets the form of which is denoted in the drawing by the contour (dash line). The side sets 17 and 19 of the cutting elements 20 and 22 have flanges 23 and 24 respectively attached thereto. The set 18 through the medium of the flanges 24 is rigidly attached, for example, by welding to the sets 17 and 19, thereby forming a single unit. The flanges 23 and 24 have holes 25 of the same diameter for fitting the tool on a drive shaft (not shown in the Figure).

In the tool blank the cutting elements 20, 21, 22 have the equal diameter and length. It is advantageous to have the width of blanks for the central set 18 twice as great as the width of blanks for the side sets 17 and 19. In the tool ready for use the length of the cutting elements 20, 21, 22 uniformly diminishes away from the axis perpendicular to the axis of rotation 0—0, towards the periphery such that their mean length remains constant. Hence, the ratio $d^4/l_s$ for all the sets is also constant. In order to exclude an adverse effect of the varying cutting ability of one set on the quality of cleaning, it is preferable to prevent variation of the maximum and minimum lengths in excess of 10 percent of the mean value. The tool of such a type is technologically convenient in assembly; by selecting the required number of sets, it is possible to assemble a tool for cleaning the rolled angles of any wing width.

Example of Calculation.

Let's assume that it is required to work out a tool with the maximum outside diameter $D_{max}=300$ mm for cleaning the angle wings having the width $\delta=40$ mm. The diameter of the cutting elements 20, 21, 22 $d=0.5$ mm is constant and their maximum length (in the blank) $l^{max}=60$ mm. Let's have the width of the working surface of a blank for the central set equal to 24 mm and that for the side sets equal to 12 mm.

Let's start the calculation with the central set 18 by determining, as in the case of a common rotating cutting tool, the width thereof on the non-working surface G. This width is equal to 36 mm. Having constructed graphically the central set 18 and having found the points of intersection thereof with the planes drawn from the apex at the angle $\alpha/2=45°$, we will obtain the diameter of the side sets 17 and 19 for the tool blank, equal to 270 mm. By this diameter and the width (12 mm) of each working surface of the side sets, we determine the width of each of the non-working surfaces F and H of the side sets 17 and 19. This width is equal to 20 mm. It should be taken into account that the interior angles of inclination of the side sets must coincide with the angles of inclination of the extreme cutting elements of the central set.

The mean length of the cutting elements in all the sets is equal to 54 mm, hence the ratio $d^4/l_s$ is constant.

The rotating cutting tool (needle-cutter) operates in the following manner.

The tool is installed and fixed on the machine drive shaft and put into rotation. Then the rolled angle is progressively fed under the tool. The internal surface of the rolled angle is aligned with the working surface of the tool and the latter is pressed to the angle surface with a preset force or preload. The moment the tool comes in contact with the surface being cleaned, a force of friction arises therebetween due to which the resilient cuting elements bend aside in the direction opposite the sense of the tool rotation. In the process of such bending an ever increasing number of the cutting elements engage into operation, thereby increasing the force of springback of the cutting elements being in contact with the cleaned surface of the rolled angle.

When the resilience of all the cutting elements engaged in operation exceeds the force required for displacing the particles of a rolled angle material, these particles will be sheared off in front of the cutting elements being at this moment in contact with the material under cleaning. Further, the cutting elements which have sheared off the particles of the rolled angle material will straighten and throw the sheared particles forward while the cutting elements going after the row being now in contact, will repeat this operation on a new place of the rolled angle. So the above operations will be repeated until the internal surface of the rolled angle fed along the tool is completely cleaned.

Due to the equal flexibility and cutting ability of the cutting elements of the herein described needle-cutters, the efficiency and durability thereof are sharply increased, and the quality of cleaning is substantially improved.

What is claimed is:

1. A rotating cutting tool (needle-cutter) comprising cutting elements assembled at least into two sets; said cutting elements are essentially pieces of wire fastened to one another at one end while other ends thereof are free: the fastened ends of said cutting elements form the internal non-working surface; the free ends of said cutting elements constitute the working surface in the form of a disc with the side edges thereof arranged at an angle substantially equal to 90°; the diameter of each said cutting element and the mean length thereof in a set are represented by the following mutually equal ratios $$d_1^4/l_{S1}^2 = d_2^4/l_{S2}^2 = \ldots d_n^4/l_{Sn}^2,$$

where:

$d_1, d_2 \ldots d_n$ are the diameters of the cutting elements in sets;

$l_{S1}, l_{S2} \ldots l_{Sn}$ are the mean lengths of the cutting elements in sets;

1, 2 . . . n are the numbers of sets.

2. A rotating cutting tool (needle-cutter) according to claim 1, wherein the cutting elements in each set have the equal mean length and the equal diameter.

3. A rotating cutting tool (needle-cutter) according to claim 1, wherein the cutting elements in each set have the different mean lengths and the different diameters.

4. A rotating cutting tool (needle-cutter) according to claim 1, wherein the cutting elements in each set have the equal diameter and the variable length uniformly diminishing away from the axis perpendicular to the axis of rotation, towards the periphery, the mean length of the cutting elements being constant.

* * * * *